US006722648B2

(12) United States Patent
Tsusaka et al.

(10) Patent No.: US 6,722,648 B2
(45) Date of Patent: Apr. 20, 2004

(54) MECHANISM FOR FORWARDLY AND REVERSELY FEEDING RECORDING MEDIUM

(75) Inventors: Shusaku Tsusaka, Nagoya (JP); Yoshiteru Hattori, Bisai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 187 days.

(21) Appl. No.: 09/945,831

(22) Filed: Sep. 5, 2001

(65) Prior Publication Data

US 2002/0038933 A1 Apr. 4, 2002

(30) Foreign Application Priority Data

Sep. 29, 2000 (JP) ..... 2000-297842

(51) Int. Cl.[7] ..... B65H 29/60; F16H 3/34

(52) U.S. Cl. ..... 271/65; 271/186; 271/301; 271/902; 74/354

(58) Field of Search ..... 271/902, 65, 301, 271/184, 186; 74/321, 352, 354

(56) References Cited

U.S. PATENT DOCUMENTS 2,275,497 A * 3/1942 Berndt ..... 242/340
2,681,035 A * 6/1954 Browne et al. ..... 118/705
2,896,873 A * 7/1959 Mageoch ..... 242/538.3
2,972,900 A * 2/1961 Bailey et al. ..... 74/354
3,684,278 A * 8/1972 Takahaski ..... 271/281
3,854,670 A * 12/1974 Bertolazzi ..... 400/219
4,105,199 A * 8/1978 Sato et al. ..... 271/122
4,487,506 A * 12/1984 Repp et al. ..... 399/401
5,697,603 A * 12/1997 Kato ..... 271/114
5,740,696 A * 4/1998 Jean et al. ..... 74/354
5,854,696 A * 12/1998 Yun ..... 358/498
5,887,868 A * 3/1999 Lambert et al. ..... 271/186
5,947,465 A * 9/1999 Kato et al. ..... 271/10.11
5,954,326 A * 9/1999 Gaarder et al. ..... 271/9.02
6,139,010 A * 10/2000 Yokoi ..... 271/225
6,151,478 A * 11/2000 Katsuta ..... 399/372
6,208,831 B1 * 3/2001 Amano ..... 399/396
6,241,237 B1 * 6/2001 Bokelman ..... 271/9.11

* cited by examiner

*Primary Examiner*—Donald P. Walsh
*Assistant Examiner*—Daniel K Schlak
(74) *Attorney, Agent, or Firm*—Oliff & Berridge, PLC

(57) ABSTRACT

A drive mechanism for rotating a drive roller includes an input transmission mechanism for transmitting a drive force from a motor, an output transmission mechanism for transmitting the drive force to the drive roller, an intermediate transmission mechanism for selectively transmitting the drive force from the input transmission mechanism to the output transmission mechanism in either a first direction or a second direction, and a switching mechanism for moving the intermediate transmission mechanism to a first position to drive the output transmission mechanism in the first direction or a second position to drive the output transmission mechanism in the second direction.

36 Claims, 7 Drawing Sheets

MECHANISM FOR FORWARDLY AND REVERSELY FEEDING RECORDING MEDIUM

BACKGROUND OF THE INVENTION

1. Field of Invention

The invention relates to a mechanism for forwardly and reversely feeding a recording medium, such as a sheet of paper.

2. Description of Related Art

A known image forming apparatus, such as a laser printer, includes a double-sided printing function for printing images on both sides of a sheet of paper. To form images on both sides of a sheet of paper, an image is first formed on one side thereof in an image forming unit. Thereafter, the sheet of paper is reversely fed again to the image forming unit where an image is formed on the other side thereof.

A reverse feeding mechanism for reversely feeding a sheet of paper is structured in the following manner. A sheet of paper having an image on one side thereof is held between a pair of reverse feedable rollers rotating in a forward direction. As the sheet of paper is fed to the rear end thereof, the reverse feedable rollers are rotated in a reverse direction with the sheet of paper being held by the reverse feedable rollers. Thus, the sheet of paper is reversely fed.

SUMMARY OF THE INVENTION

A mechanism for forwardly and reversely feeding a recording medium according to the invention may ensure the reliable and smooth rotation of reverse feedable rollers in a forward direction and a reverse direction. The mechanism according to the invention achieves significant manufacturing cost reduction, and running cost reduction, as well as endurance improvements.

In various embodiments of a drive mechanism for forwardly and reversely feeding a recording medium, the drive mechanism comprises an input transmission mechanism for transmitting a drive force from a motor, an output transmission mechanism for transmitting the drive force to the drive roller, an intermediate transmission mechanism for selectively transmitting the drive force from the input transmission mechanism to the output transmission mechanism in either a first direction or a second direction and a switching mechanism for moving the intermediate transmission mechanism to a first position to drive the output transmission mechanism in the first direction or a second position to drive the output transmission mechanism in the second direction.

In various embodiments of a method for driving a drive mechanism for forwardly and reversely feeding a recording medium, the method comprises the steps of transmitting a drive force from an input transmission mechanism, transmitting the drive force from the input transmission mechanism in either a first direction or a second direction by an intermediate transmission mechanism, outputting the drive force to a drive roller with an output transmission mechanism and moving the intermediate transmission mechanism to a first position to drive the output transmission mechanism in the first direction or a second position to drive the output transmission mechanism in the second direction by a switching mechanism.

BRIEF DESCRIPTION OF THE DRAWINGS

An exemplary embodiment of the invention will be described in detail with reference to the following figures wherein.

DETAILED DESCRIPTION OF PREFERRED EMBODIMENTS

An exemplary embodiment of the invention will be described in detail with reference to the figures.

Figure 1:
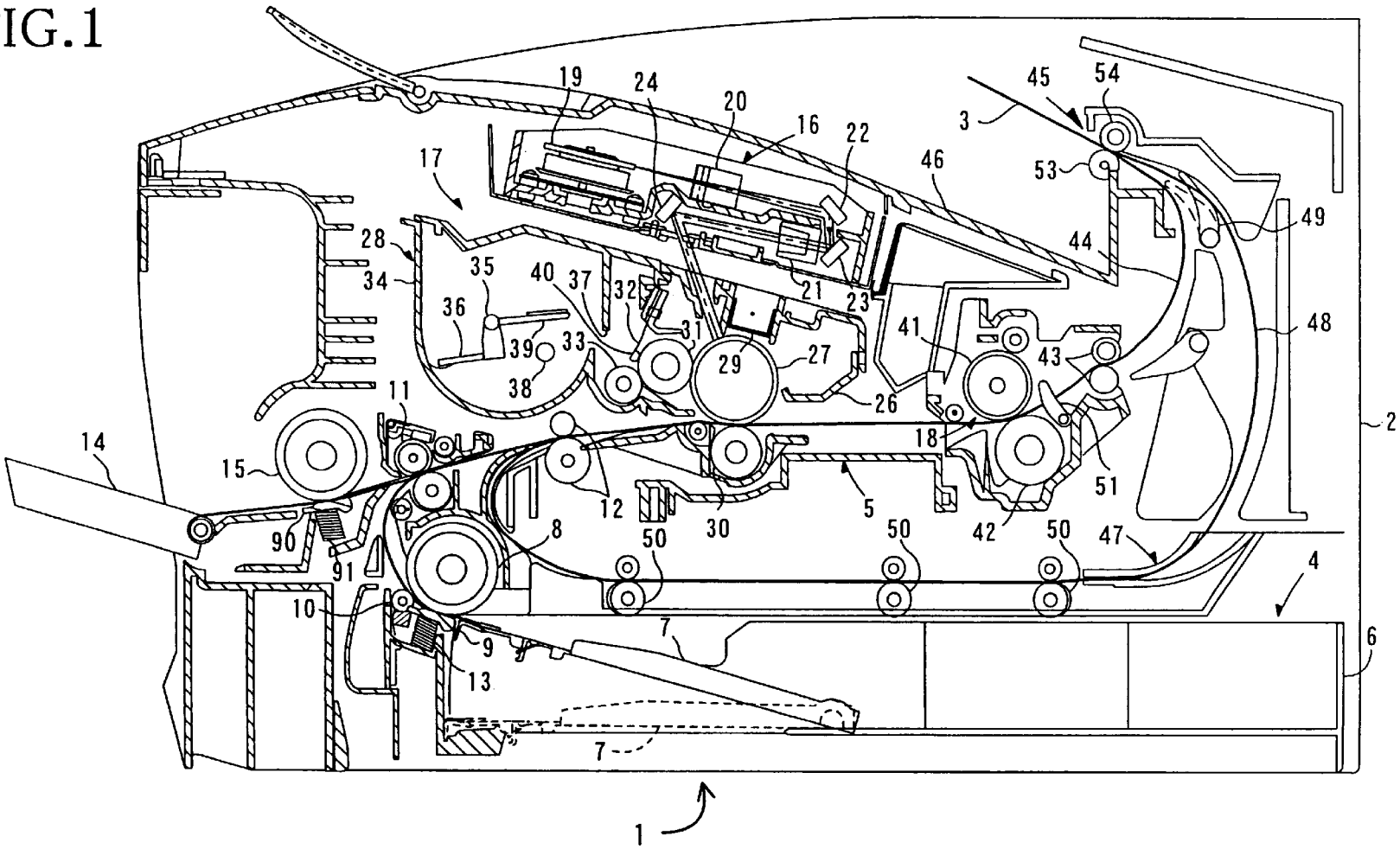
FIG. 1 is a side cross-sectional view showing a laser printer according to an exemplary embodiment of the invention.

FIG. 1 is a side cross-sectional view showing a laser printer of an image forming apparatus according to an exemplary embodiment of the invention. In FIG. 1, the laser printer 1 is provided in a main casing 2 with a feeder unit 4 that feeds sheets 3 of paper as a recording medium, and an image forming unit 5 that forms an image on the paper sheet 3.

The feeder unit 4 includes a paper tray 6, a paper pressure plate 7, a pick-up roller 8, a separation pad 9, paper powder removing rollers 10, 11, and register rollers 12. The paper tray 6 is removably set in the bottom of the main casing 2. The paper pressure plate 7 is provided in the paper tray 6. The pick-up roller 8 and the separation pad 9 are provided at an upper end of the paper tray 6. The paper powder removing rollers 10, 11 are provided downstream of the pick-up roller 8 in a paper sheet feeding direction. The register rollers 12 are provided downstream of the paper powder removing rollers 10, 11 in the sheet feeding direction.

The paper pressure plate 7 supports a stack of the paper sheets 3. The paper pressure plate 7 pivots on one end far from the pick-up roller 8, so that the other end of the paper pressure plate 7 near the pick-up roller 8 can move up and down. A spring (not shown) is disposed on the underside of the paper pressure plate 7. The spring urges the plate 7 upwardly. As the amount of the paper sheets 3 stacked on the pressure plate 7 increases, the pressure plate 7 pivots downward about the one end far from the pick-up roller 8, against an urging force of the spring. The pick-up roller 8 and the separation pad 9 are disposed to face each other. A spring 13, disposed on the underside of the separation pad 9, presses the separation pad 9 against the pick-up roller 8. The topmost paper sheet 3 on the pressure plate 7 is pressed against the pickup roller 8 by the spring (not shown) disposed on the underside of the pressure plate 7. As the pick-up roller 8 rotates, the topmost paper sheet 3 is picked up and fed between the pick-up roller 8 and the separation pad 9. The paper sheet 3 is fed to the paper powder removing rollers 10, 11 where paper powders are removed. Thereafter, the paper sheet 3 is fed to a pair of the register rollers 12. The register rollers 12 register the paper sheet 3, and then feed the paper sheet 3 to the image forming unit 5.

The feeder unit 4 further includes a multi-purpose tray 14, and a multi-purpose pick-up roller 15 and a multi-purpose separation pad 90 that feed the paper sheet 3 stacked on the multi-purpose tray 14. The multi-purpose pick-up roller 15 and the multi-purpose separation pad 90 are disposed to face each other. The multipurpose separation pad 90 is pressed against the multi-purpose pick-up roller 15 by a spring 91 provided on the underside of the multi-purpose separation pad 90. By the rotation of the multi-purpose pick-up roller 15, the paper sheets 3 stacked on the multi-purpose tray 14 are sandwiched between the multi-purpose pick-up roller 15 and the multi-purpose separation pad 90, and then separated one by one.

The image forming unit 5 includes a scanner unit 16, a process unit 17, and a fixing unit 18.

The scanner unit 16 is provided in an upper portion of the main casing 2. The scanner unit 16 includes a laser emitting section (not shown), a polygon mirror 19 that is driven to spin, lenses 20 and 21, and reflecting mirrors 22, 23, and 24. A laser beam emitted from the laser emitting section is modulated based on image data. As indicated by broken lines in FIG. 1, the laser beam emitted from the laser emitting section passes through or reflects off the polygon mirror 19, the lens 20, the reflecting mirrors 22 and 23, the lens 21, and the reflecting mirror 24 in this order. The laser beam scans at a high speed across a surface of a photosensitive drum 27 of the process unit 17. The photosensitive drum 27 will be described below in more detail.

The process unit 17 is disposed below the scanner unit 16. The process unit 17 includes a photosensitive member cartridge 26 detachably mounted on the main casing 2 and a developing cartridge 28 detachably mounted on the photosensitive member cartridge 26. The photosensitive member cartridge 26 includes the photosensitive drum 27, a scorotron charger 29, and a transfer roller 30. The developing cartridge 28 includes a developing roller 31, a toner thickness regulating blade 32, a toner supply roller 33, and a toner box 34.

The toner box 34 accommodates a positively charging non-magnetic single component toner, as a developing agent. The toner to be used is a polymerized toner that is obtained by copolymerizing monomers, such as styrene-based monomers, for example, styrene, and polymerizable monomers, such as acrylic-based monomers, for example, acrylic acid, alkyl (C1–C4) acrylate, and alkyl (C1–C4) methacrylate, using a known polymerization method, such as a suspension polymerization method. Polymerized toner particles are spherical in shape, having excellent fluidity. The toner is mixed with a coloring material, such as carbon black, and wax, as well as silica as an external additive to improve the fluidity of the toner. A toner particle size is approximately 6 to 10 mm.

Disposed in a substantially central portion of the toner box 34 is a rotating shaft 35. The rotating shaft 35 supports an agitator 36 that agitates the toner in the toner box 34. The toner is discharged from a toner supply opening 37 provided in the toner box 34. Provided in a side wall of the toner box 34 is a window 38 for detecting the amount of toner remaining in the toner box 34. The window 38 is cleaned by a cleaner 39 supported by the rotating shaft 35.

The toner supply roller 33 is rotatably disposed to a side of the toner supply opening 37. The developing roller 31 is rotatably disposed to face the toner supply roller 33. The toner supply roller 33 and the developing roller 31 contact each other to apply some pressures to each other. A bias is applied to the developing roller 31.

The toner supply roller 33 includes a metal roller shaft covered by a roller portion formed of a conductive foam material. The developing roller 31 includes a metal roller shaft covered by a roller portion formed of a conductive rubber material. More specifically, the roller portion of the developing roller 31 is formed of conductive urethane rubber or silicone rubber including fine carbon particles. A surface of the roller portion of the developing roller 31 is coated with urethane rubber or silicone rubber including fluorine. A bias is applied to the developing roller 31 relative to the photosensitive drum 27.

Disposed adjacent to the developing roller 31 is the toner thickness regulating blade 32 that regulates the thickness of the toner on the developing roller 31. The regulating blade 32 includes a blade portion formed of a metal plate spring and a contact portion 40 attached to one end of the blade portion. The contact portion 40 has a semicircular cross-sectional shape and is formed of insulating silicone rubber. The other end of the blade portion is supported near the developing roller 31 by the developing cartridge 28. The contact portion 40 presses the developing roller 31 with the elasticity of the plate spring.

The toner discharged through the toner supply opening 37 is supplied onto the toner supply roller 33 and further onto the developing roller 31 by the rotation of the toner supply roller 33. The toner is positively charged through friction charging at the contact portion of the toner supply roller 33 and the developing roller 31. As the developing roller 31 rotates, the toner supplied onto the developing roller 31 enters between the contact portion 40 of the regulating blade 32 and the developing roller 31 where the toner is again charged through friction charging, to a sufficient degree. The toner, passing between the contact portion 40 and the developing roller 31, is formed into a uniform-thickness thin toner layer on the developing roller 31.

The photosensitive drum 27 is rotatably provided to a side of the developing roller 31, to face the developing roller 31. The photosensitive drum 27 includes a main drum which is grounded. The surface of the photosensitive drum 27 is formed by a positively charging photosensitive layer including polycarbonate.

The scorotron charger 29 is disposed above the photosensitive drum 27 with a predetermined distance therebetween, to prevent the scorotron charger 29 from contacting the photosensitive drum 27. The scorotron charger 29 is a positively charging charger that generates corona discharge from a charging wire made from tungsten or other material. The scorotron charger 29 uniformly and positively charges the surface of the photosensitive drum 27.

A laser beam emitted from the scanner unit 16 scans at a high speed across the surface of the photosensitive drum 27, which is uniformly and positively charged by the scorotron charger 29. The surface of the photosensitive drum 27 is selectively exposed to the laser beam based on image data, forming an electrostatic latent image thereon. By the rotation of the developing roller 31 having the positively charged toner thereon, the toner is brought into contact with the photosensitive drum 27. The toner is supplied to the electrostatic latent image formed on the surface of the photosensitive drum 27, making the toner image visible.

The laser printer 1 is structured to collect the toner which remains on the photosensitive drum 27 by the developing roller 31, after the image is transferred with the transfer roller 30 onto the paper sheet 3. This toner collection method is known as a cleaner-less system. With the use of the cleaner-less system to collect the toner remaining on the photosensitive drum 27, the laser printer 1 does not have to be provided with a cleaning apparatus, such as a blade, or a waste toner reservoir. Therefore, the laser printer 1 may have simplified structures and smaller size, thereby achieving cost reduction.

The transfer roller 30 is disposed below the photosensitive drum 27 to face the drum 27. The transfer roller 30 is rotatably supported in the photosensitive member cartridge 26. The transfer roller 30 includes a metal roller shaft covered by a roller portion formed of a conductive rubber material. As stated above, a bias is applied to the transfer roller 30 relative to the photosensitive drum 27. The visible toner image on the photosensitive drum 27 is transferred onto the paper sheet 3 while the paper sheet 3 passes between the photosensitive drum 27 and the transfer roller 30.

The fixing unit 18 is disposed downstream of the process unit 17 in the paper sheet feeding direction. The fixing unit 18 includes a heat roller 41 and a pressure roller 42 that is pressed against the heat roller 41, as well as a pair of second paper supply rollers 43 disposed downstream of the heat roller 41 and the pressure roller 42 in the paper sheet feeding direction. The heat roller 41 is formed of metal and is provided with a halogen lamp for generating heat. When the paper sheet 3, which has the toner transferred thereon in the process unit 17, passes between the heat roller 41 and the pressure roller 42, the toner is fused by heat to fixedly adhere the toner to the paper sheet 3. After the toner is fixedly adhered to the paper sheet 3, the sheet 3 is conveyed by the second paper supply rollers 43, to a discharge path 44. The paper sheet 3 is fed to discharge rollers 45, through the discharge path 44, and is discharged by the discharge rollers 45 onto a discharge tray 46.

A sensor 51 detects the rear edge of the paper sheet 3 and is disposed upstream of the second paper supply rollers 43 in the paper sheet feeding direction. To reversely feed the paper sheet 3, rotation of the discharge rollers 45 is changed from a forward direction to a reverse direction at a predetermined timing after the detection of the rear edge of the paper sheet 3 by the sensor 51.

The laser printer 1 is provided with a reverse feeding unit 47 to form images on both sides of the paper sheet 3. The reverse feeding unit 47 includes the discharge rollers 45 as reverse feedable rollers, a reverse feeding path 48, a flapper 49, and a plurality of pairs of reverse feeding rollers 50.

The discharge rollers 45 include a drive roller 53 and a follower roller 54 disposed above the drive roller 53 to sandwich the paper sheet 3 between the drive roller 53 and the follower roller 54. The discharge rollers 45 are driven to rotate in a forward or reverse direction by a roller driving unit 52, which will be described below in more detail. The discharge rollers 45 rotate in the forward direction to discharge the paper sheet 3 toward the discharge tray 46. The discharge rollers 45 rotate in the reverse direction to reversely feed the paper sheet 3.

The reverse feeding path 48 is provided in a generally vertical direction, to feed the paper sheet 3 from the discharge rollers 45 to the reverse feeding rollers 50 disposed below the image forming unit 5. An upstream-side end of the reverse feeding path 48 in the paper sheet feeding direction is disposed close to the discharge rollers 45. A downstream-side end of the reverse feeding path 48 is disposed close to the reverse feeding rollers 50.

The flapper 49 is normally urged by a force of a spring in such a manner that the reverse feeding path 48 is opened. After the toner is fixed onto the paper sheet 3, the paper sheet 3 is fed to push the flapper 49 open. As the rear edge of the paper sheet 3 passes through the flapper 49, the reverse feeding path 48 is formed again by the force of the spring.

A plurality of pairs of the reverse feeding rollers 50 are provided above the paper tray 6 in a substantially horizontal direction. A pair of the reverse feeding rollers 50 on the most upstream side in the paper sheet feeding direction is disposed close to the downstream-side end of the reverse feeding path 48. A pair of the reverse feeding rollers 50 on the most downstream side in the paper sheet feeding direction is disposed below the register rollers 12.

Operations of the reverse feeding unit 47 when images are printed on both sides of the paper sheet 3 will be described below.

As the paper sheet 3 having an image formed on one side thereof is fed to the discharge rollers 45 by the second paper supply rollers 43 through the discharge path 44, the discharge rollers 45 rotate in the forward direction while holding the sheet 3 therebetween, to feed the sheet 3 in the feeding direction thereof toward the discharge tray 46. As the rear edge of the paper sheet 3 is held between the discharge rollers 45 while the sheet 3 is being discharged onto the discharge tray 46, the discharge rollers 45 stop rotating in the forward direction. Thereafter, the discharge rollers 45 rotate in the reverse direction. The flapper 49 is operated to direct the paper sheet 3 into the reverse feeding path 48 from the discharge tray 46. Thus, the paper sheet 3 is reversely fed. As described above, the rotation of the discharge rollers 45 is changed from the forward direction to the reverse direction as a predetermined time elapses after the sensor 51 has detected the rear edge of the paper sheet 3. As will be described below in detail, the rotation of the discharge rollers 45 is changed by exciting a trigger solenoid 81 of the roller driving unit 52 (FIG. 2).

Thereafter, as the flapper 49 finishes directing the paper sheet 3, the flapper 49 is operated to return to its original position, that is, the flapper 49 acts to direct the paper sheet 3 conveyed by the second paper supply rollers 43 to the discharge rollers 45. The paper sheet 3 reversely fed into the reverse feeding path 48 is conveyed to the reverse feeding rollers 50 and then up to the register rollers 12. The register rollers 12 register the paper sheet 3 fed with a printed side thereof facing downwardly. Then, the sheet 3 is transported to the image forming unit 5 where an image is formed on the other side of the paper sheet 3. Thus, the images are formed on both sides of the paper sheet 3.

The reverse feeding unit 47 is provided with the roller driving unit 52, to drivingly rotate the discharge rollers 45 in the forward direction or the reverse direction. The roller driving unit 52 will be described in detail below, with reference to FIGS. 2 through 7.

Figure 2:
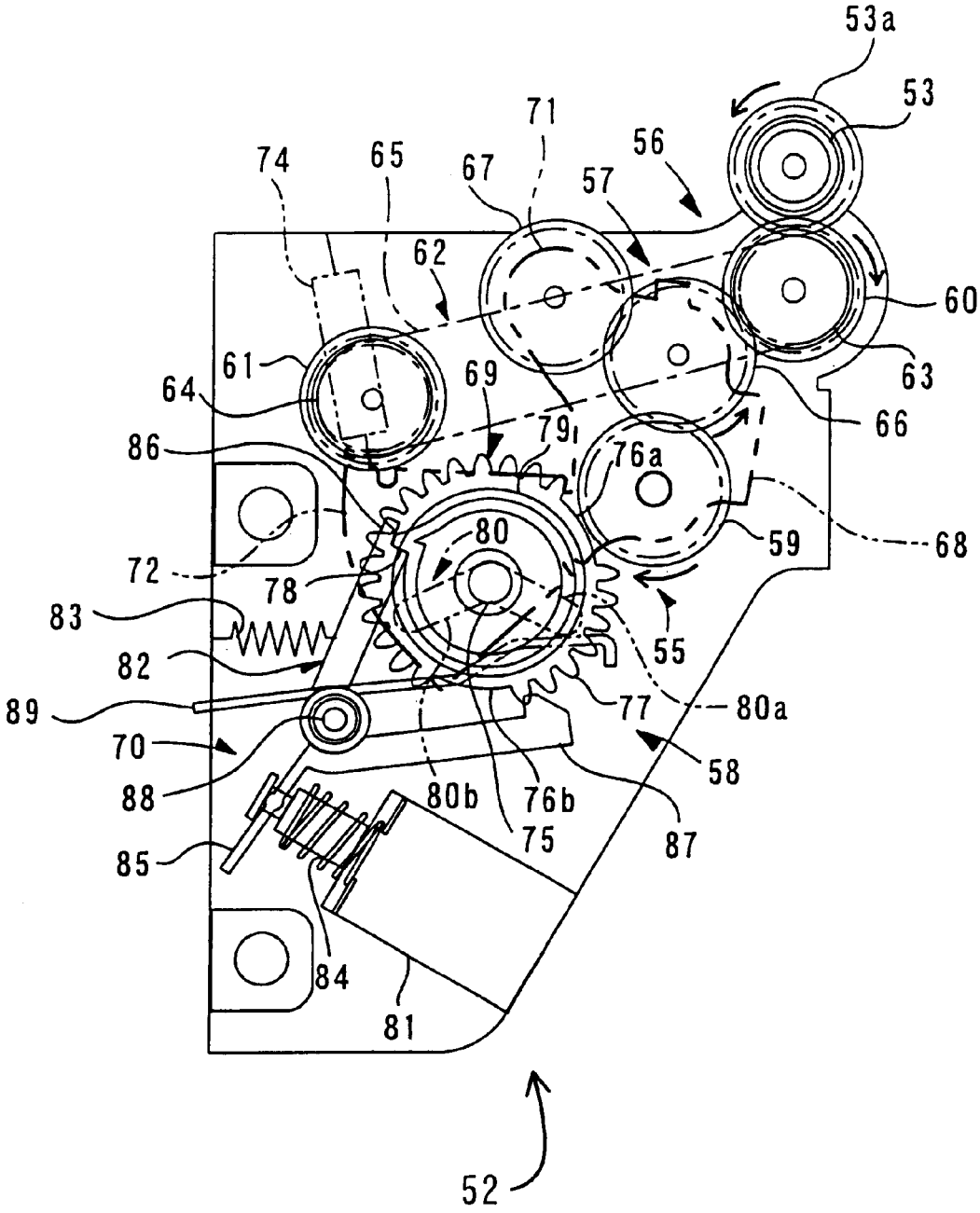
FIG. 2 is a side cross-sectional view showing a roller driving unit of the laser printer shown in FIG. 1 in a forward feeding state.

In FIG. 2, the roller driving unit 52 includes an input transmission mechanism section 55, an output transmission mechanism section 56, an intermediate transmission mechanism section 57, and a drive switching mechanism section 58.

Rotation of a motor (not shown) provided in the main casing 2 is transmitted to the input transmission mechanism section 55. The input transmission mechanism section 55 includes a gear train having a plurality of gears. An input gear 59 is provided to the most downstream side of the input transmission mechanism section 55 in a motor rotation transmission direction.

The output transmission mechanism section 56 is disposed above the input gear 59.

The output transmission mechanism section 56 includes a first output gear 60, a second output gear 61, and a belt transmission mechanism section 62. The first output gear 60 and the second output gear 61 are disposed with a predetermined distance therebetween.

The belt transmission mechanism section 62 includes a first belt gear 63 integrally formed on the same axis of the first output gear 60, a second belt gear 64 integrally formed on the same axis of the second output gear 61, and an endless belt 65 winded around the first belt gear 63 and the second belt gear 64.

Rotation transmitted to the first output gear 60 is then transmitted, through the first belt gear 63 and the endless belt 65, to the second belt gear 64, and then to the second output gear 61. Conversely, rotation transmitted to the second output gear 61 is transmitted, through the second belt gear 64 and the endless belt 65, to the first belt gear 63, and then to the first output gear 60. With the above-described structure, as one of the first output gear 60 and the second output gear 61 is rotated through the transmission of a drive force thereto, the drive force is then transmitted to the other one of the first output gear 60 and the second output gear 61, through the belt transmission mechanism section 62, so that one and the other one of the first output gear 60 and the second output gear 61 are rotated in the same direction.

A drive roller gear 53*a* that rotates together with the drive roller 53 is disposed above the first output gear 60, to engage with the first output gear 60. As the drive force is transmitted to the first output gear 60 and consequently the first output gear 60 is rotated, the drive roller 53 is rotated in the forward direction, through the first output gear 60 and the drive roller gear 53*a*, which are components of a mechanism to rotate the drive roller 53 in the forward direction. As the drive force is transmitted to the second output gear 61 and consequently the second output gear 61 is rotated, the drive roller 53 is rotated in the reverse direction, through the second output gear 61, the second belt gear 64, the endless belt 65, the first belt gear 63, the first output gear 60, and the drive roller gear 53*a*, which are components of a mechanism to rotate the drive roller 53 in the reverse direction.

The intermediate transmission mechanism section 57 is disposed above the input transmission mechanism section 55. The intermediate transmission mechanism section 57 includes a first transmission gear 66 that is engaged with the input gear 59, and a second transmission gear 67 that is engaged with the first transmission gear 66. The first transmission gear 66 and the second transmission gear 67 rotate in a direction opposite to each other. The first transmission gear 66 and the second transmission gear 67 are disposed between the first output gear 60 and the second output gear 61, which are provided with a predetermined distance therebetween.

The intermediate transmission mechanism section 57 is supported by a movable supporting plate 68 of the drive switching mechanism section 58. The drive switching mechanism 58 includes the movable supporting plate 68, a cam member 69, and a trigger mechanism section 70.

The movable supporting plate 68 is pivotally supported on a rotating shaft of the input gear 59. The movable supporting plate 68 includes a first plate section 71 that is disposed outward of the first transmission gear 66 and the second transmission gear 67 and supports those two transmission gears 66, 67, and a second plate section 72 that is disposed outwardly of the cam member 69 and has a generally sectorial shape.

The movable supporting plate 68 is movable between a drive force transmitting position to rotate the drive gear 53 in the forward direction and another drive force transmitting position to rotate the drive gear 53 in the reverse direction. In the drive force transmitting position to rotate the drive gear 53 in the forward direction, the first transmission gear 66 and the first output gear 60 are engaged with each other and the second transmission gear 67 and the second output gear 61 are not engaged with each other. In the drive force transmitting position to rotate the drive gear 53 in the reverse direction, the second transmission gear 67 and the second output gear 61 are engaged with each other and the first transmission gear 66 and the first output gear 60 are not engaged with each other.

Figure 7:
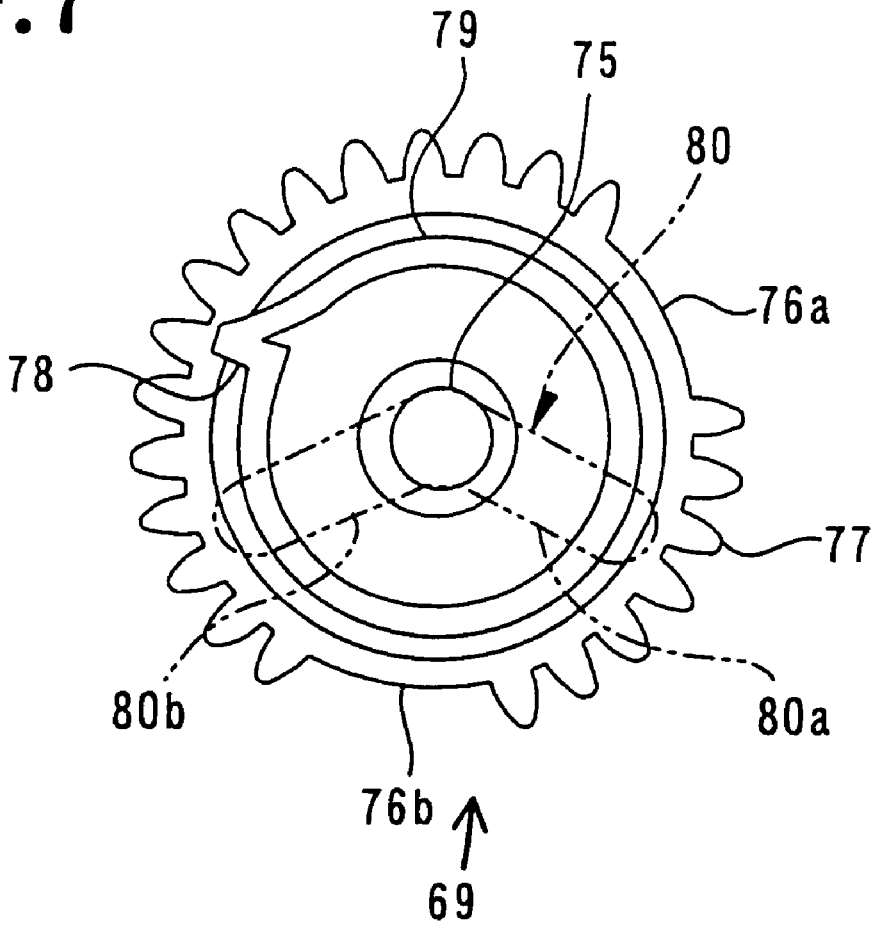
FIG. 7 is an enlarged side cross-sectional view of a cam member shown in FIGS. 2 through 6.

The cam member 69 is rotatably supported to a side of the input gear 59 by a supporting shaft 75. The cam member 69 includes a gear portion 77, an engagement disk 79, and a projection 80 that are integrally formed. As shown in FIG. 7, the gear portion 77 has a first non-toothed portion 76*a* and a second non-toothed portion 76*b* formed on an outer surface thereof at predetermined positions. The engagement disk 79 is provided to one side of the cam member 69. The engagement disk 79 is provided with an engagement portion 78 that can be engaged with a trigger lever 82, which will be described below, in the direction of a circumference of the cam member 69. The projection 80 is provided to the other side of the cam member 69. The projection 80 includes a first projection 80*a* and a second projection 80*b* extending from the supporting shaft 75 across the diameter of the cam member 69, forming a generally "V"-shape therewith.

Fixed to an upper end portion of the second plate section 72 is an end of a spring 74, whose other end is fixed to an upper end portion of the roller driving unit 52. The movable supporting plate 68 is normally placed in the drive force transmitting position to rotate the drive roller 53 in the forward direction where an upper end portion of second plate section 72 is urged upwardly by an urging force of the spring 74. In the second plate section 72, both side ends corresponding to the radius of the sector are bent inwardly toward the cam member 69.

The first projection 80*a* is formed thin enough to prevent the first projection 80*a* from contacting a side end portion of the second plate section 72. The second projection 80*b* is formed thick enough to contact the side end portion of the second plate section 72.

The first non-toothed portion 76*a* and the second non-toothed portion 76*b* are formed on the outer surface of the gear portion 77, with a predetermined space apart. More specifically, the first non-toothed portion 76*a* and the second non-toothed portion 76*b* are formed at predetermined positions such that the first non-toothed portion 76*a* faces the input gear 59 in a forward feeding state shown in FIG. 2, and the second non-toothed portion 76*b* faces the input gear 59 in a reverse feeding state shown in FIG. 5.

The trigger mechanism section 70 is disposed below the cam member 69. The trigger mechanism section 70 includes a trigger solenoid 81, the trigger lever 82, and a trigger spring 89.

The trigger solenoid 81 is disposed below the cam member 69 with a predetermined distance therebetween. The trigger solenoid 81 is provided with a plunger 84 that moves down during the excitation of the trigger solenoid 81. For the trigger solenoid 81, an inexpensive compact solenoid, for example, having a pull-in force of approximately 3.2 to 0.9 N at 0.5 to 3 mm stroke of the plunger 84, may be used rather than an expensive power solenoid.

The trigger lever 82 includes a mounting portion 85, a first engagement portion 86 and a second engagement portion 87 that are integrally formed. The mounting portion 85 is formed like a plate and is mounted onto the plunger 84. The first engagement portion 86 and the second engagement portion 87 extend from the mounting portion 85 to dispose the engagement disk 79 therebetween, forming a generally "V" shape therewith.

Base ends of the first engagement portion 86 and the second engagement portion 87 forming a generally "V" shape therewith are movably supported by a movable shaft 88. The first engagement portion 86 is engaged with the engagement portion 78 in the forward feeding state shown in FIG. 2. The second engagement portion 87 is engaged with the engagement portion 78 in the reverse feeding state shown in FIG. 5. A spring 83 is provided at a position in the lengthwise direction of the first engagement portion 86, with one end thereof fixed to a side end portion of the roller driving unit 52.

When the trigger solenoid 81 is not under excitation, the trigger lever 82 is moved by an urging force of the spring 83 to a position where the first engagement portion 86 is engaged with the engagement portion 78 of the engagement disk 79. When the plunger 84 is moved downwardly as the trigger solenoid 81 is excited, the trigger lever 82 is moved to a position where the second engagement portion 87 is engaged with the engagement portion 78 of the engagement disk 79, against the urging force of the spring 83.

The trigger spring 89 is mounted on the movable shaft 88, which is a fulcrum of the trigger lever 82. One end of the trigger spring 89 is fixed on a side end portion of the roller driving unit 52. In the forward feeding state shown in FIG. 2, the trigger spring 89 contacts the first projection 80*a*, so that the first projection 80*a* is urged in an upward direction in FIG. 2. In the reverse feeding state shown in FIG. 5, the trigger spring 89 contacts the second projection 80*b*, so that the second projection 80*b* is urged in an upward direction in FIG. 5.

In the forward feeding state shown in FIG. 2, the first non-toothed portion 76*a* of the cam member 69 faces the input gear 59, and the engagement portion 78 of the engagement disk 79 is engaged with the first engagement portion 86 of the trigger lever 82. In this state, the drive force from the input gear 59 is not transmitted to the cam member 69. Even when an upward force is applied such that the cam member 69 is rotated in the countercheck direction by the trigger spring 89 urging the first projection 80*a*, the transmission of the drive force from the input gear 59 to the cam member 69 remains interrupted because the engagement of the engagement portion 78 with the first engagement portion 86 is against the urging force of the trigger spring 89.

Figure 5:
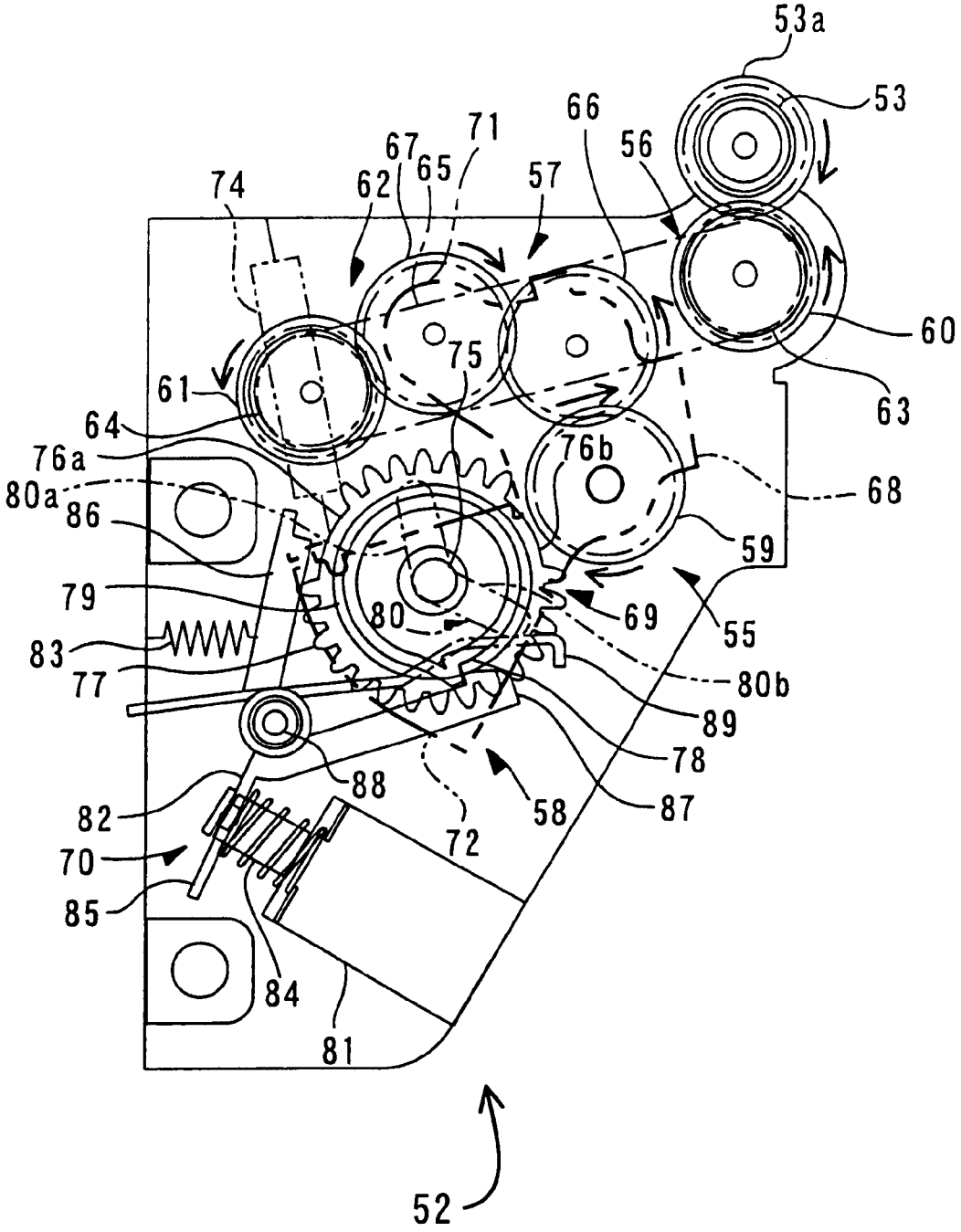
FIG. 5 is a side cross-sectional view showing the roller driving unit of the laser printer shown in FIG. 1, in a reverse feeding state.

In the reverse feeding state shown in FIG. 5, the second non-toothed portion 76*b* of the cam member 69 faces the input gear 59, and the engagement portion 78 of the engagement disk 79 is engaged with the second engagement portion 87 of the trigger lever 82. In this state, the drive force from the input gear 59 is not transmitted to the cam member 69. Even when an upward force is applied such that the cam member 69 is rotated in the countercheck direction by the trigger spring 89 urging the second projection 80*b*, the transmission of the drive force from the input gear 59 to the cam member 69 remains interrupted because the engagement of the engagement portion 78 with the second engagement portion 87 is against the urging force of the trigger spring 89.

Operations to reversely feed the paper sheet 3 in the roller driving unit 52 structured as described above will be described below.

In the forward feeding state, such as shown in FIG. 2 where the discharge rollers 45 discharge the paper sheet 3 onto the discharge tray 46, the drive roller 53 of the discharge rollers 45 rotates in the forward direction.

In the forward feeding state, the trigger solenoid 81 is in a non-excitation state. By the urging force of the spring 83, the first engagement portion 86 of the trigger lever 82 is engaged with the engagement portion 78 of the engagement disk 79. In this state, the first non-toothed portion 76*a* is kept to face the input gear 59. Therefore, the rotation of the input gear 59 is not transmitted to cam member 69. Since the second plate section 72 is urged upwardly by the urging force of the spring 74, the movable supporting plate 68 is kept in the drive force transmitting position to rotate the drive roller 53 in the forward direction. In this state, the first transmission gear 66 and the first output gear 60 are engaged with each other. However, the second transmission gear 67 and the second output gear 61 is not engaged with each other. Therefore, as the rotation of the motor (not shown) is transmitted to the input gear 59, the input gear 59 rotates in the clockwise direction, as indicated by an arrow in FIG. 2. The rotation of the input gear 59 is transmitted to the first output gear 60 through the first transmission gear 66, and then to the drive roller gear 53*a* through the first output gear 60. Thus, the drive roller 53 is rotated in the forward direction to feed the paper sheet 3 toward the discharge tray 46.

In the forward feeding state, the rotation of the first output gear 60 is transmitted to the second output gear 61, through the belt transmission mechanism section 62. However, the second output gear 61 is idle. The rotation of the first transmission gear 66 is transmitted to the second transmission gear 67. However, the second transmission gear 67 is also idle.

Figure 3:
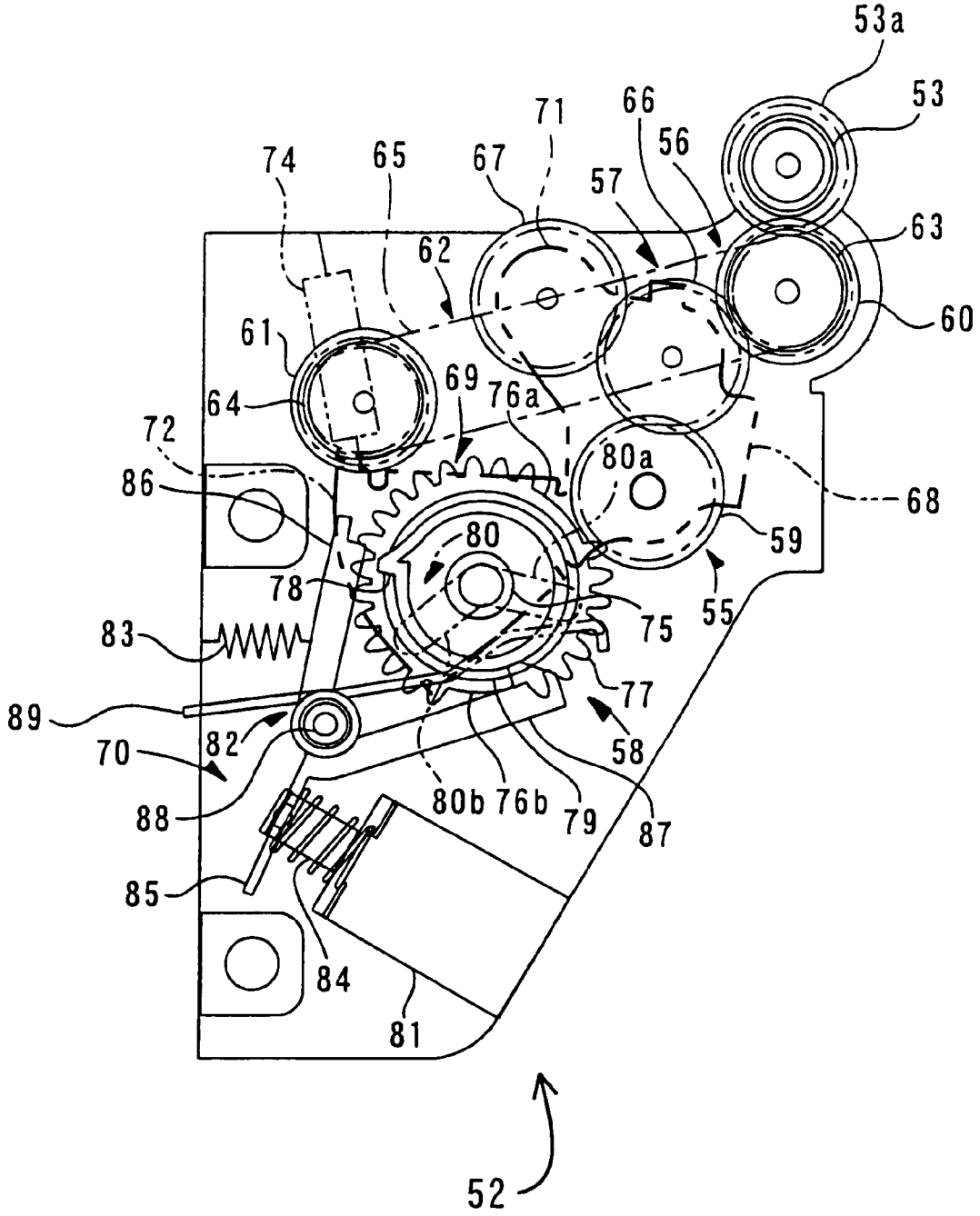
FIG. 3 is a side cross-sectional view showing the roller driving unit of the laser printer shown in FIG. 1, at the start of operation for reverse feeding.

As a predetermined time has passed since the sensor 51 detects the rear edge of the paper sheet 3, the trigger solenoid 81 is excited. Thereafter, the plunger 84 is moved downwardly, as shown in FIG. 3, so that the first engagement portion 86 of the trigger lever 82 is disengaged from the engagement portion 78 of the engagement disk 79, against the urging force of the spring 83. By the urging force of the trigger spring 89 applied to the first projection 80*a*, the cam member 69 is rotated together with the first projection 80*a* in the counterclockwise direction. As the cam member 69 is rotated together with the first projection 80*a*, the gear portion 77 is engaged with the input gear 59. Accordingly, the rotation of the input gear 59 is transmitted to the cam member 69. As the input gear 59 is rotated in the clockwise direction, the cam member 69 is rotated in the counterclockwise direction.

Figure 4:
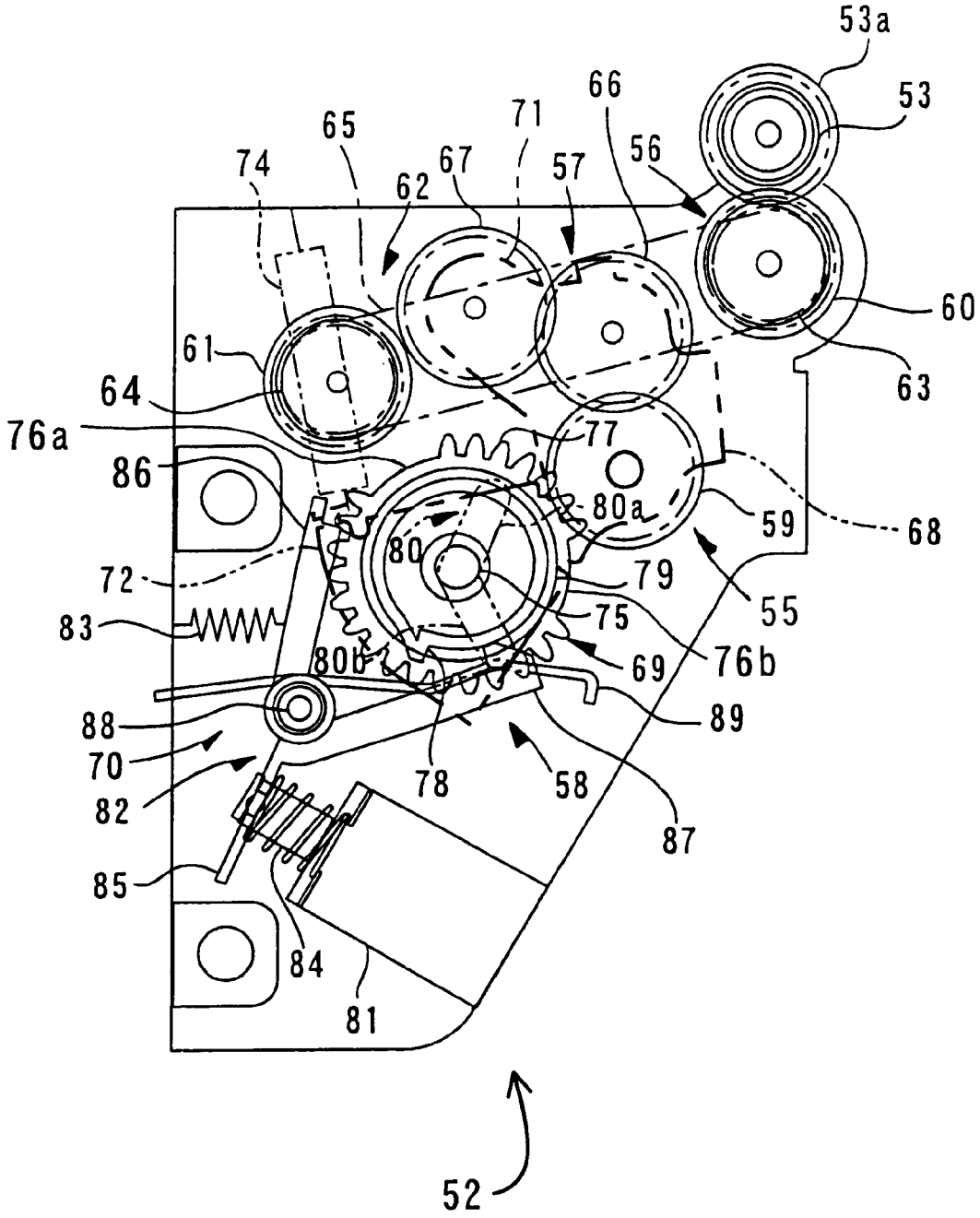
FIG. 4 is a side cross-sectional view showing the roller driving unit of the laser printer shown in FIG. 1, in the middle of operation for reverse feeding.

The cam member 69 is rotated together with the second projection 80*b*. As shown in FIG. 4, the second projection 80*b* contacts the side end portion of the second plate section 72, pressing the second plate section 72 downwardly. The movable supporting plate 68 is pivotally moved in the counterclockwise direction about a supporting point thereof provided on the same axis of the input gear 59.

The movable supporting plate 68 continues to move until the second non-toothed portion 76*b* faces the input gear 59 as the cam member 69 rotates. When the movable supporting plate 68 moves to the drive force transmitting position to rotate the drive roller 53 in the reverse direction, the second non-toothed portion 76*b* faces the input gear 59, and the second engagement portion 87 of the trigger lever 82 is engaged with the engagement portion 78 of the engagement disk 79, as shown in FIG. 5. When the second non-toothed portion 76*b* faces the input gear 59 and the second engagement portion 87 of the trigger lever 82 is engaged with engagement portion 78 of the engagement disk 79, the rotation of the cam member 69 stops.

When the movable supporting plate 68 is in the drive force transmitting position to rotate the drive roller 53 in the reverse direction, the second transmission gear 67 and the second output gear 61 are engaged with each other, but the first transmission gear 66 and the first output gear 60 are not engaged with each other. The trigger spring 89 contacting the second projection 80*b* urges the second projection 80*b* upwardly. However, the second projection 80*b* is prevented from rotating by the engagement of the second engagement portion 87 of the trigger lever 82 with the engagement portion 78 of the engagement disk 79. Thus, a condition that the second non-toothed portion 76*b* faces the input gear 59 is maintained. Accordingly, the rotation of the input gear 59 is not transmitted to the cam member 69.

In the reverse feeding as shown in FIG. 5, the rotation of the input gear 59 in the clockwise direction, as shown by an arrow in FIG. 5, is transmitted to the drive roller gear 53*a*, through the first transmission gear 66, the second transmission gear 67, the second output gear 61, the second belt gear 64, the endless belt 65, the first belt gear 63, and the first output gear 60. Thus, the drive roller 53 is rotated in the reverse direction, and the paper sheet 3 is reversely fed into the reverse feeding path 48.

Figure 6:
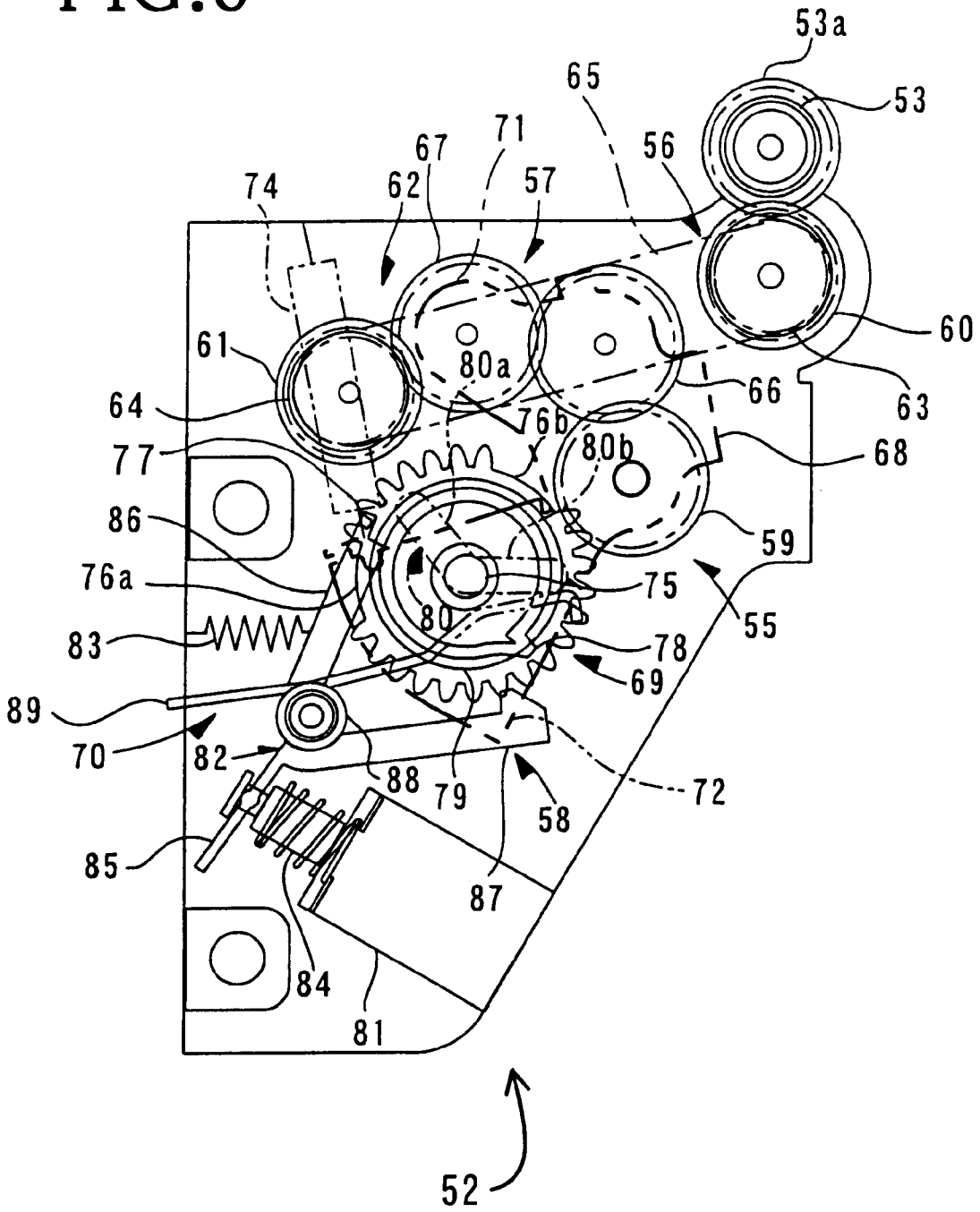
FIG. 6 is a side cross-sectional view showing the roller driving unit of the laser printer shown in FIG. 1, at the start of operation for forward feeding.

After feeding the paper sheet 3 in the reverse direction, the trigger solenoid 81 is again placed under the non-excitation state. In this state, as shown in FIG. 6, the plunger 84 returns to its original position and the trigger lever 82 is moved by the urging force of the spring 83, so that the second engagement portion 87 of the trigger lever 82 is disengaged from the engagement portion 78 of the engagement disk 79.

The cam member 69 is rotated in the counterclockwise direction together with the second projection 80*b*, by the urging force of the trigger spring 89 applied to the second projection 80*b*. As the cam member 69 is rotated together with the second projection 80*b*, the gear portion 77 is engaged with the input gear 59. Accordingly, the rotation of the input gear 59 is transmitted to the cam member 69. As the input gear 59 is rotated in the clockwise direction, the cam member 69 is rotated in the counterclockwise direction.

As the cam member 69 is rotated, the second projection 80*b* is moved away from the side end portion of the second plate section 72 of the movable supporting plate 68. Since the second plate section 72 is urged upwardly by the spring 74, the second plate section 72 moves upwardly. Therefore, the movable supporting plate 68 pivots in the clockwise direction about a supporting point thereof provided on the same axis of the input gear 59. Thus, the movable supporting plate 68 is placed in the drive force transmitting position to rotate the drive roller 53 in the forward direction, as shown in FIG. 2. In this state, the first transmission gear 66 and the first output gear 60 are engaged with each other. As described above, the rotation of the input gear 59 in the clockwise direction is transmitted to the first output gear 60 through the first transmission gear 66, and then to the drive roller gear 53*a* through the first output gear 60. Thus, the drive roller 53 is rotated in the forward direction.

As the cam member 69 is rotated and the first non-toothed portion 76*a* faces the input cam 59, the rotation of the cam member 69 stops. As shown in FIG. 2, the engagement portion 78 and the first engagement portion 86 are engaged with each other.

As is apparent from the foregoing description, in the roller driving unit 52 according to the exemplary embodiment, when the paper sheet 3 is fed toward the discharge tray 46, the first transmission gear 66 and the first output gear 60 are engaged with each other to rotate the drive roller 53 in the forward direction. When the paper sheet 3 is reversely fed, the movable supporting plate 68 is moved according to the rotation of the cam member 69. By the movement of the movable supporting plate 68, the second transmission gear 67 and the second output gear 61 are engaged with each other, thereby rotating the drive roller 53 in the reverse direction.

With the above-described structures, the drive roller 53 may be properly and smoothly rotated in the forward direction or the reverse direction, so that the paper sheet 3 may be fed in the forward direction or the reverse direction.

In the drive roller unit 52, the movable supporting plate 68 is moved by rotating the cam member 69 through the transmission of the rotation of the input gear 59 that is always rotated in one direction (clockwise direction). By the movement of the movable supporting plate 68, the rotating directions of the drive roller 53 may be changed, so that a specific motor that can rotate in the forward and reverse directions does not have to be provided to change the rotating directions of the drive roller 53. Consequently, manufacturing costs may be greatly reduced.

In the drive roller unit 52, the drive force is input from the input gear 59 to the cam member 69 to change the rotating direction of the drive roller 53 to the forward direction, by bringing the trigger solenoid 81 into the non-excitation state. The second transmission gear 67 and the second output gear 61 are disengaged from each other at a proper timing and the first transmission gear 66 and the first output gear 60 are engaged with each other. Consequently, the discharge rollers 45 may be properly rotated in the forward direction to feed the paper sheet 3 in the forward feeding direction.

The drive force is input from the input gear 59 to the cam member 69 to change the rotating direction of the drive roller 53 to the reverse direction, by bringing the trigger solenoid 81 into the excitation state. The first transmission gear 66 and the first output gear 60 are disengaged from each other at a proper timing and the second transmission gear 67 and the second output gear 61 are engaged with each other. Consequently, the discharge rollers 45 may be properly rotated in the reverse direction to feed the paper sheet 3 in the reverse feeding direction.

The trigger solenoid 81 is only used as a trigger to disengage the engagement portion 78 of the engagement disk 79 from the first engagement portion 86 or the second engagement portion 87 of the trigger lever 82. Therefore, an expensive high-power-consuming power solenoid does not have to be used, but an inexpensive compact low-power-consuming solenoid may be used. Therefore, the manufacturing cost reduction may be achieved while stable switching operations for the forward feeding and the reverse feeding of the paper sheet 3 are ensured. In addition, running costs of the laser printer 1 may be reduced by power savings achieved by the use of a low-power-consuming solenoid. Further, by the use of the low-power-consuming solenoid, the solenoid 81 could not overheat, thus the endurance of the solenoid 81 may be improved.

In the forward feeding state shown in FIG. 2, the first engagement portion 86 of the trigger lever 82 is engaged with the engagement portion 78 of the engagement disk 79 of the cam member 69. In the reverse feeding state shown in FIG. 5, the second engagement portion 87 of the trigger lever 82 is engaged with the engagement portion 78. Thus, the rotation of the cam member 69 can be stopped in the forward feeding state and the reverse feeding state. Therefore, the rotation of the input cam 59 may be transmitted to the drive roller 53.

Although the foregoing exemplary embodiment is described taking the discharge rollers 45 as an example of the reverse feedable rollers defined in the appended claims, a reverse feeding device of the invention is not limited to a roller that discharges the paper sheet 3, but may also be applied widely to other components that can feed the paper sheet 3 in the forward direction and the reverse direction.

The following two structures for a mechanism to reversely feed a paper sheet may be employed, other than the above-described structure.

(1) The reverse feedable rollers are directly driven by a motor that can rotate in the forward direction and the reverse direction, to rotate in a forward direction and a reverse direction; and (2) A switching gear is provided that switches rotation transmission paths for transmitting the rotation of a motor to the reverse feedable rollers. The reverse feedable rollers are rotated in the forward direction and the reverse direction by switching the transmission paths with the switching gear, using a solenoid.

However, there are some problems with the above-described two structures to rotate the reverse feedable rollers in the forward direction and the reverse direction. When such a motor as described in (1) is provided specifically to rotate the reverse feedable rollers in the forward and reverse directions, manufacturing costs are significantly increased.

When such a solenoid as described in (2) is used, an increase in the manufacturing cost may be prevented because the specific motor does not have to be provided. However, the switching gear has to be operated, when rotation is transmitted through one of the rotation transmission paths for the forward or reverse feeding, to switch the rotation transmission paths to the other one. For switching the rotation transmission paths with the switching gear using a solenoid, a great drive force is required to interrupt or connect the rotation transmission path. To obtain the great drive force, an expensive power solenoid needs to be used. This limits the reduction of the manufacturing costs.

In addition, when the power solenoid is used, an acoustic insulating device or a soundproofing device has to be provided since noises of the power solenoid during its operation are significant. Since power consumption of a power solenoid is high, the power solenoid leads to an increase in running costs of an image forming apparatus, such as a laser printer. Further, the high-power-consuming power solenoid may overheat while being repeatedly used.

The structures employed in the invention may solve the problems of the above-described two structures.

While the invention has been described with reference to the exemplary embodiment, it is to be understood that the invention is not restricted to the particular forms shown in the foregoing exemplary embodiment. Various modifications and alterations can be made thereto without departing from the scope of the invention.

What is claimed is:

1. A drive mechanism for rotating a drive roller, comprising:

an input transmission mechanism for transmitting a drive force from a motor;

an output transmission mechanism for transmitting the drive force to the drive roller;

an intermediate transmission mechanism for selectively transmitting the drive force from the input transmission mechanism to the output transmission mechanism in either a first direction or a second direction; and a switching mechanism for moving the intermediate transmission mechanism to a first position to drive the output transmission mechanism in the first direction or a second position to drive the output transmission mechanism in the second direction, wherein the switching mechanism comprises:

a cam member, connectable to the input transmission mechanism, for moving the intermediate transmission mechanism between the first position and the second position, the cam member comprising a first gear portion, a first non-toothed portion, a second gear portion, and a second non-toothed portion formed on an outer surface of the cam member, wherein the first non-toothed portion faces the input transmission mechanism when the intermediate transmission mechanism is in the first position and the second non-toothed portion faces the input transmission mechanism when the intermediate transmission mechanism is in the second position; and a trigger mechanism for selectively engaging the cam member with the input transmission mechanism, the trigger mechanism selectively engaging the first gear portion with the input transmission mechanism to move the cam member so that the first non-toothed portion faces the input transmission mechanism and selectively engaging the second gear potion with the input transmission mechanism to move the cam member so that the second non-toothed portion faces the input transmission mechanism.

2. The drive mechanism of claim 1, wherein the motor only rotates in one direction.

3. The drive mechanism of claim 1, wherein the output transmission mechanism further comprises:

a first output gear;

a second output gear; and a transmission mechanism for transferring the drive force to either the first output gear or the second output gear when either the second output gear or the first output gear receives the drive force.

4. The drive mechanism of claim 3, wherein the intermediate transmission mechanism engages the first output gear when in the first position and the second output gear when in the second position.

5. The drive mechanism of claim 1, wherein the intermediate transmission mechanism comprises:

a first transmission gear engaged with the input transmission mechanism; and a second transmission gear engaged with the first transmission gear, wherein the first transmission gear engages the output transmission mechanism when in the first position and the second transmission gear engages the output transmission mechanism when in the second position.

6. The drive mechanism of claim 1, wherein the switching mechanism comprises:

a support plate for supporting the intermediate transmission mechanism, the support mechanism being moved between the first position and the second position by the cam member.

7. The drive mechanism of claim 6, wherein the drive force from the input transmission mechanism moves the support plate via the cam member to switch a rotation direction of the drive roller.

8. The drive mechanism of claim 6, wherein the trigger mechanism comprises a solenoid and a trigger lever with a first engagement portion and a second engagement portion, the cam member comprises a third engagement portion and the solenoid moves the trigger lever while in a first state to engage the first engagement portion with the third engagement portion when driving the output transmission mechanism in the first direction and the solenoid moves the trigger lever while in a second state to engage the second engagement portion with the third engagement portion when driving the output transmission mechanism in the second direction.

9. The drive mechanism of claim 1, wherein the drive force from the input transmission mechanism moves the intermediate transmission mechanism to switch a rotation direction of the drive roller.

10. A method of operating a drive mechanism, comprising the steps of:

transmitting a drive force from an input transmission mechanism;

transmitting the drive force from the input transmission mechanism in either a first direction or a second direction by an intermediate transmission mechanism;

outputting the drive force to a drive roller with an output transmission mechanism; and moving the intermediate transmission mechanism with a switching mechanism including a cam member with a first gear portion, a first non-toothed portion, a second gear portion and a second non-toothed portion formed on an outer surface of the cam member, wherein the input transmission mechanism engages the first gear portion to move the intermediate transmission mechanism to a first position to drive the output transmission mechanism in the first direction and to place the first non-toothed portion adjacent to the input transmission mechanism and the input transmission mechanism engages the second gear portion to move the intermediate transmission mechanism to a second position to drive the output transmission mechanism in the second direction and to place the second non-toothed portion adjacent to the input transmission mechanism.

11. The method of claim 10, wherein the input transmission mechanism comprises a motor which only rotates in one direction.

12. The method of claim 10, wherein the output transmission mechanism comprises a first output gear, a second output gear and a transmission mechanism for transferring the drive force to either the first output gear or the second output gear when either the second output gear or the first output gear receives the drive force.

13. The method of claim 12, wherein the intermediate transmission mechanism engages the first output gear when in the first position and the second output gear when in the second direction.

14. The method of claim 10, wherein the intermediate transmission mechanism comprises a First transmission gear engaged with the input transmission mechanism and second transmission gear engaged with the first transmission gear, wherein the first transmission gear engages the output transmission mechanism when in the first position and the second transmission gear engages the output transmission mechanism when in the second position.

15. The method of claim 10, wherein the switching mechanism comprises a support plate for supporting and moving the intermediate transmission mechanism between the first position and second position, the cam member connectable to the input transmission section for moving the support plate and a trigger mechanism for selectively engaging the cam member with the input transmission section.

16. The method of claim 15, wherein the drive force from the input transmission mechanism moves the support plate via the cam member to switch a rotation direction of the drive roller.

17. The method of claim 15, wherein the trigger mechanism comprises a solenoid and a trigger lever with a first engagement portion and a second engagement portion, the cam member comprises a third engagement portion and the solenoid moves the trigger lever while in a first state to engage the first engagement portion with the third engagement portion when driving the output transmission mechanism in the first direction and the solenoid moves the trigger lever while in a second state to engage the second engagement portion with the third engagement portion when driving the output transmission mechanism in the second direction.

18. The method of claim 10, wherein the drive force from the input transmission mechanism moves the intermediate transmission mechanism to switch a rotation direction of the drive roller.

19. An image forming apparatus, comprising:

an image forming unit for forming an image onto a recording medium;

a supply path for supplying a recording medium to the image forming unit;

a discharge path for discharging the recording medium from the image forming unit;

a return path, connected with the discharge path, for returning the recording medium to the image forming unit; and a drive mechanism, located along the discharge path, for driving a drive roller in a first direction to discharge the recording medium and a second direction to return the recording medium along the return path, wherein the drive mechanism comprises:

an input transmission mechanism for transmitting a drive force from a motor;

an output transmission mechanism for transmitting the drive force to the drive roller;

an intermediate transmission mechanism for selectively transmitting the drive force from the input transmission mechanism to the output transmission mechanism to drive the drive roller in either the first direction or the second direction; and a switching mechanism for moving the intermediate transmission mechanism to a first position to drive the drive roller in the first direction or a second position to drive the drive roller in the second direction, wherein the switching mechanism comprises:

a support plate for supporting and moving the intermediate transmission mechanism between the first position and the second position;

a cam member, connectable to the input transmission mechanism for moving the support plate; and a trigger mechanism for selectively engaging the cam member with the input transmission section.

20. The image forming apparatus of claim 19, wherein the motor only rotates in one direction.

21. The image forming apparatus of claim 19, wherein the output transmission mechanism further comprises:

a first output gear;

a second output gear; and a transmission mechanism for transferring the drive force to either the first output clear or the second output gear when either the second output gear or the first output gear receives the drive force.

22. The image forming apparatus of claim 21, wherein the intermediate transmission mechanism engages the first output gear when in the first position and the second output gear when in the second position.

23. The image forming apparatus of claim 19, wherein the intermediate transmission mechanism comprises:

a first transmission gear engaged with the input transmission mechanism; and a second transmission gear engaged with the first transmission gear, wherein the first transmission gear engages the output transmission mechanism when in the first position and the second transmission gear engages the output transmission mechanism when in the second position.

24. The image forming apparatus of claim 19, wherein the cam member further comprises a first gear portion, a first non-toothed portion, a second gear portion, and a second non-toothed portion formed on an outer surface of the cam member, wherein the first non-toothed portion faces the input transmission mechanism when the intermediate transmission mechanism is in the first position and the second non-toothed portion faces the input transmission mechanism when the intermediate transmission mechanism is in the second position; and the trigger mechanism selectively engages the first gear portion with the input transmission mechanism to move the cam member so that the first non-toothed portion faces the input transmission mechanism and selectively engages the second gear potion with the input transmission mechanism to move the cam member so that the second non-toothed portion faces the input transmission mechanism.

25. The image forming apparatus of claim 19, wherein the drive force from the input transmission mechanism moves the intermediate transmission mechanism to switch a rotation direction of the drive roller.

26. The image forming apparatus of claim 19, wherein the drive force from the input transmission mechanism moves the support plate via the cam member to switch a rotation direction of the drive roller.

27. The image forming apparatus of claim 19, wherein the trigger mechanism comprises a solenoid and a trigger lever with a first engagement portion and a second engagement portion, the cam member comprises a third engagement portion and the solenoid moves the trigger lever while in a first state to engage the first engagement portion with the third engagement portion when driving the output transmission mechanism in the first direction and the solenoid moves the trigger lever while in a second state to engage the second engagement portion with the third engagement portion when driving the output transmission mechanism in the second direction.

28. A method of forming an image by an image forming apparatus, comprising the steps of:

supplying a recording medium to the image forming apparatus;

forming the image onto the recording medium; and discharging the recording medium to either a discharge path or a return path by operating a drive mechanism, the operation of the drive mechanism comprising the steps of:

transmitting a drive force from an input transmission mechanism;

transmitting the drive force from the input transmission mechanism in either a first direction or a second direction by an intermediate transmission mechanism;

outputting the drive force to a drive roller with an output transmission mechanism; and moving the intermediate transmission mechanism with a switching mechanism including a cam member with a first gear portion, a first non-toothed portion, a second gear portion and a second non-toothed portion formed on an outer surface of the cam member, wherein the input transmission mechanism engages the first gear portion to move the intermediate transmission mechanism to a first position to drive the output transmission mechanism in the first direction and to place the first non-toothed portion adjacent to the input transmission mechanism and the input transmission mechanism engages the second gear portion to move the intermediate transmission mechanism to a second position to drive the output transmission mechanism in the second direction and to place the second non-toothed portion adjacent to the input transmission mechanism.

29. The method of claim 28, wherein the input transmission mechanism comprises a motor which only rotates in one direction.

30. The method of claim 28, wherein the output transmission mechanism comprises a first output gear, a second output gear and a transmission mechanism for transferring the drive force to either the first output gear or the second output gear when either the second output gear or the first output gear receives the drive force.

31. The method of claim 30, wherein the intermediate transmission mechanism engages the first output gear when in the first position and the second output gear when in the second direction.

32. The method of claim 28, wherein the intermediate transmission mechanism comprises a first transmission gear engaged with the input transmission mechanism and second transmission gear engaged with the first transmission gear, wherein the first transmission gear engages the output transmission mechanism when in the first position and the second transmission gear engages the output transmission mechanism when in the second position.

33. The method of claim 28, wherein the switching mechanism comprises a support plate for supporting and moving the intermediate transmission mechanism between the first position and second position, the cam member connectable to the input transmission section for moving the support plate and a trigger mechanism for selectively engaging the cam member with the input transmission section.

34. The method of claim 33, wherein the drive force from the input transmission mechanism moves the support plate via the cam member to switch a rotation direction of the drive roller.

35. The method of claim 33, wherein the trigger mechanism comprises a solenoid and a trigger lever with a first engagement portion and a second engagement portion, the cam member comprises a third engagement portion and the solenoid moves the trigger lever while in a first state to engage the first engagement portion with the third engagement portion when driving the output transmission mechanism in the first direction and the solenoid moves the trigger lever while in a second state to engage the second engagement portion with the third engagement portion when driving the output transmission mechanism in the second direction.

36. The method of claim 28, wherein the drive force from the input transmission mechanism moves the intermediate transmission mechanism to switch a rotation direction of the drive roller.

* * * * *